US009685087B2

(12) United States Patent
Berckefeldt

(10) Patent No.: US 9,685,087 B2
(45) Date of Patent: Jun. 20, 2017

(54) REMOTE AIR TRAFFIC SURVEILLANCE DATA COMPOSITING BASED ON DATALINKED RADIO SURVEILLANCE

(71) Applicant: Honeywell International Inc., Morristown, NJ (US)

(72) Inventor: Richard Berckefeldt, Paola, KS (US)

(73) Assignee: Honeywell International Inc., Morris Plains, NJ (US)

( * ) Notice: Subject to any disclaimer, the term of this patent is extended or adjusted under 35 U.S.C. 154(b) by 391 days.

(21) Appl. No.: 14/450,056

(22) Filed: Aug. 1, 2014

(65) Prior Publication Data

US 2016/0035225 A1 Feb. 4, 2016

(51) Int. Cl.
*G08G 5/04* (2006.01)
*G08G 5/00* (2006.01)

(52) U.S. Cl.
CPC ..... *G08G 5/0008* (2013.01); *G08G 5/0013* (2013.01); *G08G 5/0021* (2013.01); *G08G 5/0078* (2013.01); *G08G 5/04* (2013.01)

(58) Field of Classification Search
CPC ..... G08G 5/0008; G08G 5/0078; G08G 5/04; G08G 5/0021; G08G 5/0013
USPC ..... 342/29–32, 36–38, 58
See application file for complete search history.

(56) References Cited

U.S. PATENT DOCUMENTS 5,570,095 A * 10/1996 Drouilhet, Jr. ..... G01S 5/0072 342/357.31
6,064,335 A * 5/2000 Eschenbach ..... B64D 43/00 340/961
6,133,867 A * 10/2000 Eberwine ..... G01S 5/0072 342/125
6,271,768 B1 * 8/2001 Frazier, Jr. ..... G08G 5/0008 340/961
6,567,037 B1 * 5/2003 Fung ..... G01S 13/91 342/29
7,148,816 B1 12/2006 Carrico
8,040,258 B2 10/2011 Ibrahim et al.
8,868,328 B1 * 10/2014 Estkowski ..... G08G 5/045 701/301

(Continued)

FOREIGN PATENT DOCUMENTS

CN 102682627 A 9/2012
DE EP 2296128 A1 * 3/2011 ..... G08G 5/0008

(Continued)

OTHER PUBLICATIONS

D. Jeon, Y. Eun and H. Kim, "Estimation fusion with radar and ADS-B for air traffic surveillance," Information Fusion (FUSION), 2013 16th International Conference on, Istanbul, 2013, pp. 1328-1335.*

(Continued)

*Primary Examiner* — John B Sotomayor
(74) *Attorney, Agent, or Firm* — Shumaker & Sieffert, P.A.

(57) ABSTRACT

In one example, a method for combining radio surveillance data includes receiving air traffic surveillance data from one or more aircraft via one or more remotely operable data link systems. The method further includes combining the air traffic surveillance data from the one or more aircraft into a composite air traffic surveillance data set. The air traffic surveillance data is based at least in part on radio surveillance messages received by the one or more aircraft from additional aircraft.

27 Claims, 7 Drawing Sheets

(56) References Cited

U.S. PATENT DOCUMENTS

| | | | | |
|---|---|---|---|---|
| 9,274,521 | B1 | 3/2016 | Stefani et al. | |
| 9,310,477 | B1 * | 4/2016 | Sampigethaya | G01S 13/91 |
| 2003/0016158 | A1 * | 1/2003 | Stayton | G08G 5/0008 342/29 |
| 2003/0016159 | A1 * | 1/2003 | Stayton | G08G 5/0052 342/30 |
| 2003/0137444 | A1 * | 7/2003 | Stone | G08G 5/0008 342/30 |
| 2004/0032367 | A1 * | 2/2004 | Smith | G01S 13/781 342/456 |
| 2006/0027651 | A1 * | 2/2006 | Berckefeldt | G01S 13/781 235/384 |
| 2009/0103452 | A1 * | 4/2009 | Horvath | H04B 7/18506 370/254 |
| 2009/0141669 | A1 * | 6/2009 | Kauffman | H04B 7/18506 370/328 |
| 2009/0248287 | A1 * | 10/2009 | Limbaugh | G08G 5/0013 701/120 |
| 2010/0090882 | A1 * | 4/2010 | Donovan | G01S 13/781 342/32 |
| 2010/0103022 | A1 * | 4/2010 | Stefani | G08G 5/0013 342/30 |
| 2011/0057830 | A1 * | 3/2011 | Sampigethaya | G01S 5/0072 342/36 |
| 2011/0140950 | A1 * | 6/2011 | Andersson | G01S 5/0072 342/32 |
| 2012/0319871 | A1 * | 12/2012 | Wise | B64F 1/20 340/961 |
| 2013/0141268 | A1 * | 6/2013 | Getson | G01S 13/9303 342/30 |
| 2013/0229298 | A1 * | 9/2013 | Eckstein | G01S 13/726 342/107 |
| 2014/0002293 | A1 | 1/2014 | Behrens et al. | |
| 2014/0197982 | A1 | 7/2014 | Wang et al. | |
| 2015/0331099 | A1 * | 11/2015 | Wu | G01S 13/876 342/32 |
| 2016/0035225 | A1 * | 2/2016 | Berckefeldt | G08G 5/0078 342/32 |

FOREIGN PATENT DOCUMENTS

| | | | | |
|---|---|---|---|---|
| DE | 102011013717 | * | 9/2012 | G08G 5/0013 |
| EP | 2296128 | A1 | 3/2011 | |
| EP | 2980775 | A1 * | 2/2016 | G08G 5/0078 |
| KR | 101240629 | B1 * | 3/2013 | G01S 5/0036 |

OTHER PUBLICATIONS

F. J. J. Rodriguez, J. R. C. Corredera and G. G. Canti, "Fusion of multiradar and ADS data in ATC systems," Radar 97 (Conf. Publ. No. 449), Edinburgh, 1997, pp. 643-647.*

K. Werner, J. Bredemeyer and T. Delovski, "ADS-B over satellite: Global air traffic surveillance from space," Digital Communications—Enhanced Surveillance of Aircraft and Vehicles (TIWDC/ESAV), 2014 Tyrrhenian International Workshop on, Rome, 2014, pp. 47-52.*

J. L. R. da Silva, J. F. B. Brancalion and D. Fernandes, "Data fusion techniques applied to scenarios including ADS-B and radar sensors for air traffic control," Information Fusion, 2009. FUSION '09. 12th International Conference on, Seattle, WA, 2009, pp. 1481-1488.*

Response to the Communication pursuant to Rules 70(2) and 70a(2) EPC dated Feb. 8, 2016, from counterpart European Application No. 15177969.1, filed Jul. 29, 2016, 14 pp.

Extended Search Report from counterpart European Application No. 15177969.1, dated Nov. 16, 2015, 9 pp.

Intention to Grant from counterpart European Application No. 15177969.1, dated Feb. 23, 2017, 43 pp.

* cited by examiner

REMOTE AIR TRAFFIC SURVEILLANCE DATA COMPOSITING BASED ON DATALINKED RADIO SURVEILLANCE

This disclosure relates to cooperative radio surveillance systems.

BACKGROUND

Air traffic control systems track positions and velocity of aircraft and help prevent aircraft collisions within the vicinity of airports. Air traffic control has traditionally been based on radar surveillance, supplemented more recently with cooperative radio surveillance techniques. Major portions of many aircraft flights take place in relatively remote areas and outside of radio surveillance or radar airspace, and follow procedural separation standards. Procedural separation in oceanic or other remote airspace not covered by ground-based radio surveillance means require the separation of air traffic at significantly larger distances than that used in radio surveillance or radar airspace.

SUMMARY

This disclosure is directed to systems, devices, and methods for combining air traffic surveillance data or other air traffic data based on data linked radio surveillance data from multiple aircraft in flight in remote airspace. In some examples, a remote air traffic surveillance data compositing system may generate a composite air traffic surveillance data set based on air traffic surveillance data from multiple aircraft and communicate the composite air traffic surveillance data set to aircraft in flight in the remote airspace. The composite air traffic surveillance data set may provide an increased level of situational awareness and air traffic safety, e.g., as compared to examples in which the air traffic surveillance data is not received from other aircraft, which may enable denser and more efficient air traffic and allotment of flight tracks in remote airspace.

In one example, a method for combining radio surveillance data includes receiving air traffic surveillance data from one or more aircraft via one or more remotely operable data link systems. The method further includes combining the air traffic surveillance data from the one or more aircraft into a composite air traffic surveillance data set. The air traffic surveillance data is based at least in part on radio surveillance messages received by the one or more aircraft from additional aircraft.

In another example, a system for combining radio surveillance data includes a receiver and a processor. The receiver is configured to receive air traffic surveillance data from one or more aircraft via one or more remotely operable data link systems. The processor is configured to combine the air traffic surveillance data from the one or more aircraft into a composite air traffic surveillance data set. The air traffic surveillance data is based at least in part on radio surveillance messages received by the one or more aircraft from additional aircraft.

In another example, a system for combining radio surveillance data includes means for receiving air traffic surveillance data from one or more aircraft via one or more remotely operable data link systems. The system further includes means for combining the air traffic surveillance data from the one or more aircraft into a composite air traffic surveillance data set. The air traffic surveillance data is based at least in part on radio surveillance messages received by the one or more aircraft from additional aircraft.

Another example is directed to a method for combining radio surveillance data. The method includes receiving radio surveillance messages comprising aircraft data from one or more aircraft. The method further includes converting the aircraft data from the radio surveillance messages to air traffic surveillance data. The method further includes transmitting the air traffic surveillance data via a remotely operable data link system to an air traffic surveillance data compositing system.

The disclosure is also directed to an article of manufacture comprising a computer-readable storage medium. The computer-readable storage medium comprises computer-readable instructions that are executable by a processor. The instructions cause the processor to perform any part of the techniques described herein. The instructions may be, for example, software instructions, such as those used to define a software or computer program. The computer-readable medium may be a computer-readable storage medium such as a storage device (e.g., a disk drive, or an optical drive), memory (e.g., a Flash memory, read only memory (ROM), or random access memory (RAM)) or any other type of volatile or non-volatile memory or storage element that stores instructions (e.g., in the form of a computer program or other executable) to cause a processor to perform the techniques described herein. The computer-readable medium may be a non-transitory storage medium.

The details of one or more examples are set forth in the accompanying drawings and the description below. Other features, objects, and advantages will be apparent from the description and drawings, and from the claims.

DETAILED DESCRIPTION

Figure 1:
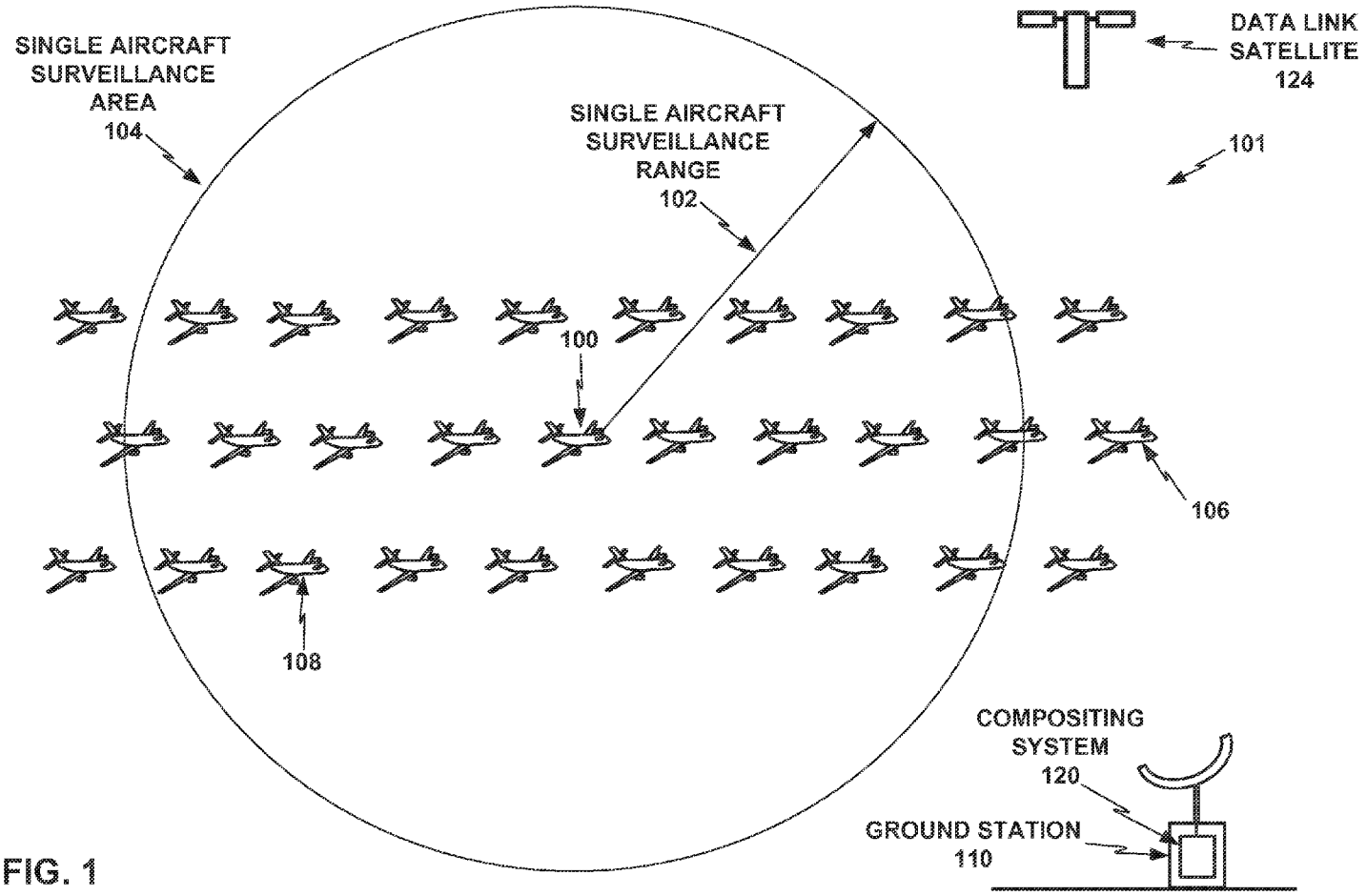
FIG. 1 depicts a conceptual diagram of an example airspace, which may cover several hundred miles on a side, in which a large number of aircraft are in flight, including a representative aircraft.

Various examples are described below generally directed to devices, systems, and methods for a radio surveillance system for a remote air traffic surveillance data compositing system that combines air traffic surveillance data based on data linked radio surveillance data from multiple aircraft in flight in remote airspace. An aircraft may collect radio surveillance data, such as Automatic Dependent Surveillance-Broadcast (ADS-B), from the aircraft's onboard systems, from surrounding aircraft in its surveillance range, or both; convert the radio surveillance data to air traffic surveillance data, or other form of processed or condensed traffic data; and transmit the air traffic surveillance data to a centralized air traffic surveillance data compositing system. The centralized air traffic surveillance data compositing system may collect air traffic surveillance data from multiple reporting aircraft and combine it into a composite air traffic display. In this way, the compositing system may accumulate air traffic data from multiple sources in order to generate relatively large sets of data.

The air traffic surveillance data compositing system may provide the composite air traffic surveillance data sets or other form of composite traffic data to one or more other entities (e.g., one or more aircraft, one or more ground systems, or any combination thereof) for various advantageous uses. An air traffic surveillance data compositing system and techniques of this disclosure may provide new levels of situational awareness and air traffic safety, and enable denser and more efficient air traffic and allotment of flight tracks and operating altitudes, particularly in remote airspace.

As noted above, procedural separation in oceanic or other remote airspace not covered by ground-based radio surveillance means require the separation of air traffic at significantly larger distances than that used in radio surveillance or radar airspace. Conventional procedural separation standards are on the order of 50 nautical miles compared to 5 nautical miles in en route radar airspace. This significantly reduces the capacity of procedural airspace. For example, the North Atlantic Track System may separate aircraft at or over 10 minutes, or 80 nautical miles, or 40 nautical miles, in different cases. The tracks are usually very full during the most desirable transit times, which makes it difficult for operators to add flights or for existing flights to request more efficient operating altitudes. Systems of this disclosure may enable safely reducing that procedural separation distance in remote airspace, such as to 25 nautical miles or only 5 nautical miles in different examples.

Cooperative radio surveillance includes Automatic Dependent Surveillance-Broadcast (ADS-B) technology. A particular aircraft may transmit ADS-B messages that include specific data (e.g., aircraft position based on GPS), and which may be received by ground-based Air Traffic Control (ATC) stations and by other aircraft. The particular aircraft may automatically transmit ADS-B messages at a specific broadcast rate. Each ADS-B message may encode a set of binary data (e.g., 112 bits of message data per message). The particular aircraft may receive ADS-B Out messages from other aircraft, in its vicinity. The aircraft's ADS-B In system may generate data from ADS-B messages received from other aircraft available for other systems or applications on the aircraft, such as for flight management and display systems.

FIG. 1 depicts a conceptual diagram of an example airspace 101, which may cover several hundred miles on a side, in which a large number of aircraft are in flight, including a representative aircraft 100. Example airspace 101 may be a section of airspace over the north Atlantic Ocean, for example, and the various aircraft shown may be en route on a variety of transatlantic flights. Example airspace 101 may coincide with a track system, such as the North Atlantic Track System (HATS). Some or all of the aircraft in this example may be equipped to generate ADS-B radio surveillance transmissions known as ADS-B Out (e.g., a transponder on board the aircraft may generate ADS-B Out transmissions), as would be typical for transatlantic commercial flights. The ADS-B radio surveillance transmissions encode ADS-B messages. Each ADS-B message may be attached to a header and may include, e.g., 112 bits of data provided to each aircraft's ADS-B transmitter from other aircraft systems. For example, the ADS-B data may include position data provided by a Global Positioning System (GPS) and/or Wide Area Augmentation System (WARS)) unit, data on ground track angle, ground speed, altitude, and other types of data.

While ADS-B messages may primarily be intended to be received by Air Traffic Control (ATC) stations, at least some of the aircraft of FIG. 1 including aircraft 100 are also equipped with ADS-B In to receive ADS-B transmissions from other aircraft. Each of the aircraft with ADS-B In capability may have a particular ADS-B reception range, such as 150 to 200 nautical miles, within which the aircraft is capable of receiving ADS-B messages from another aircraft. Aircraft 100 is shown with surveillance range 102, which provides coverage over a surveillance area 104, as shown in FIG. 1, such that surveillance area 104 covers most of the aircraft flying in the airspace shown in FIG. 1. Aircraft 100 and analogous reporting aircraft may therefore generate air traffic surveillance data for a radio surveillance range defining a minimum radius around each of the reporting aircraft, such that the minimum radius of the surveillance range may be at least 150 nautical miles or at least 200 nautical miles in some examples. As depicted, the aircraft in FIG. 1 may be flying with a procedural separation of 50 nautical miles apart from the nearest aircraft in a traffic lane, and the surveillance range 102 of aircraft 100 may be 200 nautical miles.

In this example, aircraft 100 may also be equipped with an air traffic display with an air traffic situational awareness (ATSA) system (which may be implemented in a form referred to as an "ATSA-AIRB" or "AIRB" system). The air traffic display aboard aircraft 100 may receive the data from the ADS-B messages and generate air traffic display in effectively real-time (e.g., within a nominal latency) based on the data from the ADS-B messages. In other words, aircraft 100 may convert the aircraft data from the ADS-B or other radio surveillance messages from surrounding aircraft, to air traffic display data. In this example, aircraft 100 also has a data link with data link satellite 124, and via data link satellite 124 with a compositing system 120 hosted in a ground-based compositing system station 110. For example, aircraft 100 may use the same data link system for communicating with compositing system 120 that aircraft 100 may also use for other systems such as a Future Air Navigation System (FANS) system (e.g., FANS 1/A, FANS 2/B) or as an automatic dependent surveillance-contract (ADS-C) system, for example. The data link via satellite 124 may enable aircraft 100 to maintain the data link throughout much or all of remote airspace regions such as over the Atlantic or Pacific Oceans. Therefore, compositing system 120 may receive air traffic surveillance data from aircraft 100 and other reporting aircraft via one or more remotely operable data link systems that may include a Future Air Navigation System (FANS) implementation, an automatic dependent surveillance contract (ADS-C) implementation, or other implementation.

Aircraft 100, using systems and methods of this disclosure, may then transmit its air traffic surveillance data, based on the ADS-B data from the typically several surrounding aircraft within surveillance area 104, via the remotely operable data link system associated with data link satellite 124, to an air traffic surveillance data compositing system 120 hosted in ground station 110. Air traffic surveillance data compositing system 120 may thus receive the ADS-B-based air traffic surveillance data from representative aircraft 100, as if air traffic surveillance data compositing system 120 had access to the air traffic surveillance on board representative aircraft 100. For example, aircraft 100 may transmit ADS-B-based air traffic surveillance data to compositing system 120 at a rate of once every five seconds or every one second, or another value in a comparable range, or other rates in other examples, compared to ADS-C transmissions at a lower rate, such as once every 18 to 20 minutes.

Also, additional aircraft within airspace 101, such as aircraft 106 and 108, may also be equipped in the same manner described above with reference to aircraft 100 and may also transmit their air traffic surveillance data, based on their ADS-B data from surrounding aircraft within their surveillance areas, via the same or other remotely operable data link system, to air traffic surveillance data compositing system 120 hosted in ground station 110. The transmission of air traffic surveillance data from the one or more participating reporting aircraft to compositing system 120 may also operate as an "on demand" request system based on interrogation of one or more of the participating reporting aircraft by compositing system 120. In this example, compositing system 120 may maintain awareness of all participating reporting aircraft and keep track of the location, special coverage, and/or age of its surveillance data. Compositing system 120 may from time to time, potentially at irregular intervals depending on ongoing determinations of requirements for updated data, send requests or interrogations to either all of or a selected subset of one or more cooperating reporting aircraft to transmit their air traffic surveillance data back to compositing system 120. Compositing system 120 may transmit requests for updated data to participating reporting aircraft either instead of or in addition to the participating reporting aircraft transmitting to compositing system 120, in different examples.

Air traffic surveillance data compositing system 120 may thus receive air traffic surveillance data from one or more aircraft, such as any one or more of aircraft 100, 106, and 108, and/or other aircraft, via a remotely operable data link system, which may include any of a variety of safety certified data link systems, and may include FANS or ADS-C operating via data link satellite 124. Air traffic surveillance data compositing system 120 may also receive air traffic surveillance data from the one or more aircraft via a remotely operable data link system in the form of any satellite system or radio transponder system that provides telephony, broadband, and/or other data services with narrow, regional, and/or global coverage. Air traffic surveillance data compositing system 120 may then combine the air traffic surveillance data from the one or more aircraft, such as any one or more of aircraft 100, 106, and 108, and/or other aircraft, into a composite air traffic surveillance data set, in this example. The air traffic surveillance data from the composite air traffic surveillance data set is based at least in part on radio surveillance messages such as ADS-B messages (or radio surveillance messages of another type), received by the one or more aircraft (e.g., aircraft 100, 106, 108, etc.) from additional aircraft, as well as potentially from positioning data onboard the own-ship (i.e., the reporting aircraft transmitting the air traffic surveillance data). That is, the air traffic surveillance data from the composite air traffic surveillance data set is based at least in part on ADS-B messages aircraft 100 received from aircraft within surveillance area 104 defined by surveillance range 102, where aircraft 100 generated air traffic surveillance data from the ADS-B messages it received from some or all of the aircraft within surveillance area 104, and communicated that air traffic surveillance data via remotely operable data link system to air traffic surveillance data compositing system 120.

The air traffic surveillance data from the composite air traffic surveillance data set may also be based at least in part on ADS-B messages aircraft 106, 108 received from aircraft within their surveillance areas defined by their surveillance ranges, such that aircraft 106, 108 each generated air traffic surveillance data from the ADS-B messages they received from some or all of the aircraft within their surveillance areas, and also communicated that air traffic surveillance data via the same or different remotely operable data link system to air traffic surveillance data compositing system 120, in this example.

While aircraft 100, 106, and 108 are discussed above, the same description may apply to any of the aircraft in airspace 101 that may participate in transmitting ADS-B or other radio surveillance based air traffic surveillance data to air traffic surveillance data compositing system 120. The air traffic surveillance data may include indications of or data on latitude, longitude, aircraft flight ID, range, bearing, ground track, ground speed, altitude, etc. for each of the other aircraft within surveillance range of each transmitting aircraft (e.g., aircraft 100, 106, 108). The data may also include a unique address for the aircraft from which the ADS-B data originated (e.g., the Mode-S address, which is a 24 bit number assigned by the International Civil Aviation Organization).

The surveillance range of various participating aircraft 100, 106, 108, etc. in airspace 101 may be around 150-200 nautical miles in some examples, and may vary from one aircraft to another. The remotely operable data link system including example data link satellite 124 may be a globally operable means of data linking between any aircraft and air traffic surveillance data compositing system 120, and may include multiple and/or relay satellites in low-Earth orbit, geosynchronous orbit, or other orbit. While ADS-B is discussed in this example, other implementations in accordance with this disclosure may use other types of radio surveillance, including modifications or extensions of ADS-B.

While any number of the aircraft in airspace 101 may participate in transmitting radio surveillance based air traffic surveillance data to air traffic surveillance data compositing system 120, a relatively small fraction of the aircraft within airspace 101 may be able to supply air traffic surveillance data compositing system 120 with data coverage of all of the aircraft within airspace 101, as further discussed below. Air traffic surveillance data compositing system 120 may thus supply an air navigation service provider (ANSP) radio surveillance coverage of a remote airspace 101 that is approaching or equivalent to the surveillance coverage of an airspace under ground-based surveillance. While the example of aircraft 100 generating ATSA or AIRB air traffic surveillance data based on ADS-B radio surveillance data is described above (i.e., converting ADS-B data from multiple aircraft into a single body of ATSA or AIRB or other air traffic surveillance data), aircraft 100 may use any of various techniques to generate air traffic surveillance data based on radio surveillance data from surrounding aircraft where the processed or generated air traffic surveillance data is smaller (or less data) than the initial radio surveillance data on which it is based.

If enough aircraft within airspace 101 participate in communicating air traffic surveillance data to air traffic surveillance data compositing system 120, the resulting surveillance coverage may be complete enough to reduce the procedural separation standard between all aircraft in flight in the remote airspace 101, without regard to which of the aircraft participate in communicating air traffic surveillance data to air traffic surveillance data compositing system 120. The reduced separation may be, for example, 25 nautical miles or less, which may at least double the airspace capacity. The composited air traffic surveillance data disclosed herein, which creates a single surveillance picture for airspace 101 based on multiple sources of data, some of which may not be within range of a particular aircraft 100, may provide a particular aircraft 100 with a better view of the aircraft traffic in airspace 101. This may provide a basis for compressing the aircraft separation standards, thereby creating more capacity in airspace 101. The compositing of air traffic data disclosed herein may be particularly useful in air spaces in which there are no ground stations, such as in a remote airspace 101 above an ocean.

The low bandwidth requirements enabled by the participating aircraft transmitting their processed air traffic surveillance data as described above instead of larger data sets (e.g., unprocessed ADS-B data from surrounding aircraft) may also support a frequent refresh rate which may be needed to support safely reducing the procedural separation standard between the aircraft in flight in remote airspace 101, as well as helping constrain bandwidth through and costs of space-based assets such as representative data link satellite 124. A safely reduced procedural separation standard between the aircraft in flight in remote airspace 101 may support safely increasing the traffic density in remote airspace 101, and in particular, increasing the traffic density in flight tracks at more efficient altitudes or more efficient routes.

While the discussion above is directed specifically to an example remote airspace 101, systems and methods of this disclosure may also be combined seamlessly with other systems such as ground-based ADS-B and/or other radio surveillance and/or ground-based radar As further described below, air traffic surveillance data compositing system 120 may also enable additional valuable services beyond real-time composite air traffic surveillance in remote airspaces as described above.

The functions performed by aircraft 100 as described above may be performed by or imputed to particular systems of aircraft 100. As discussed above, aircraft 100 may receive and aggregate radio surveillance messages from surrounding aircraft, generate air traffic surveillance data based on those radio surveillance messages, and transmit that air traffic surveillance data to air traffic surveillance data compositing system 120, each of which may be implemented by one or more particular systems of aircraft 100, such as an air traffic data display system 260 that includes an integrated Traffic Collision Avoidance System (TCAS) computer 262, an air traffic data surveillance system (e.g., an AIRB or other ATSA air traffic data surveillance system), and/or a navigation information system. Details of systems on board aircraft 100 are further discussed below with reference to FIG. 2.

While the discussion above is presented in terms of an example directed to aircraft reporting air traffic surveillance data for a remote airspace, analogous examples may also be directed to any type of vehicles that report surveillance data collected on other vehicles of any type, that process or compress the initial surveillance data from vehicles within their surveillance range and then transmit the aggregated and processed traffic surveillance data via a data link to a compositing system. The reporting vehicles may include one or more aircraft, maritime vessels, ground vehicles, submarines, suborbital vehicles, orbital or hyperbolic launch vehicles, and/or spacecraft, or any combination of any of the above. The reporting vehicles may collect, process, and report surveillance data from any one or more of any combination of vehicles indicated above. The compositing system may receive the condensed traffic data from one or more vehicles via one or more remotely operable data link systems, such as including one or more data link satellites. The compositing system may combine the condensed traffic data from the one or more vehicles into a composite traffic data set. The condensed traffic data is based at least in part on surveillance messages received by the one or more vehicles from additional vehicles.

Figure 2:
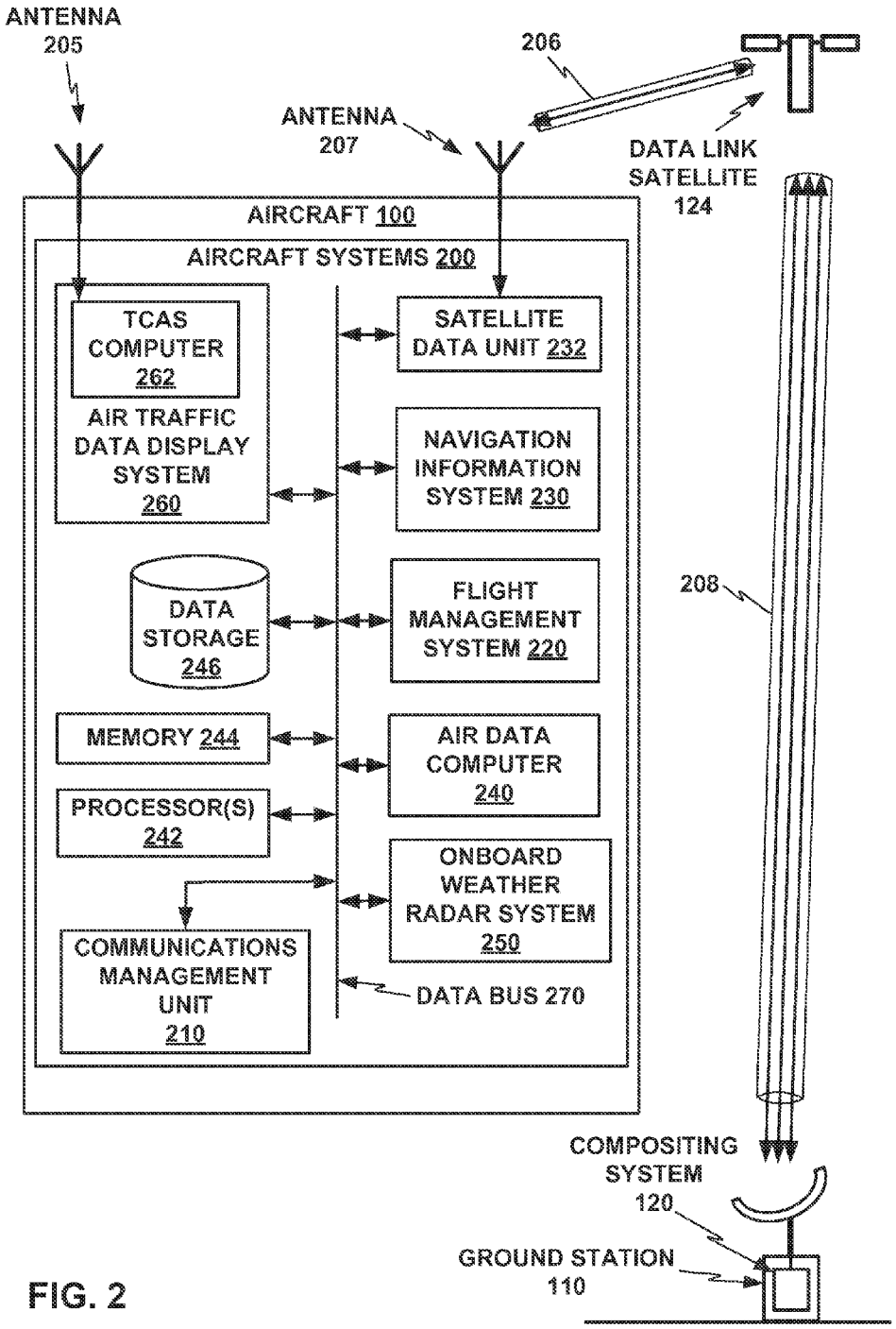
FIG. 2 depicts a functional block diagram of an example aircraft with example onboard aircraft systems configured to perform functions described below, including receiving Automatic Dependent Surveillance-Broadcast (ADS-B) or other radio surveillance messages from surrounding aircraft, generating air traffic surveillance data based on those radio surveillance messages, and transmitting that air traffic surveillance data to an air traffic surveillance data compositing system.

FIG. 2 depicts a functional block diagram of example aircraft 100 with an example onboard aircraft systems 200 configured to perform functions described above, including receiving ADS-B or other radio surveillance messages from surrounding aircraft, generating air traffic surveillance data based on those radio surveillance messages, potentially also including aircraft 100's own position data and/or other data, and transmitting that air traffic surveillance data to air traffic surveillance data compositing system 120. Aircraft systems 200 may be implemented onboard an aircraft such as aircraft 100 of FIG. 1 as described above. Aircraft systems 200 include a TCAS computer 262, a navigation information system 230, and an air traffic data display system 260 (e.g., an AIRB or other ATSA air traffic data surveillance system). TCAS computer 262 may receive the ADS-B data via an antenna 205 from other aircraft (from transponders aboard the other aircraft). In some examples, TCAS computer 262, air traffic data surveillance system 260, and/or compositing system 120 may use a specified message protocol for communicating air traffic surveillance data based on the radio surveillance data for aircraft 100 to transmit to compositing system 120, and/or for compositing system 120 to communicate to aircraft systems 200, such as with requests for information. Aircraft systems 200 may also include other systems, such as a communications management unit (CMU) 210, a flight management system (FMS) 220, an air data computer 240, and an onboard weather radar system 250.

TCAS computer 262 is coupled to antenna 205, or potentially to more than one antenna in some examples, and may receive and/or transmit signals via antenna 205. Aircraft systems 200 may also include one or more processors 242, memory 244, and data storage 246, which are individually, separately depicted in FIG. 2 but one or more of which may be included as part of TCAS computer 262, CMU 210, flight management system 220, navigation information system 230, air data computer 240, or as part of or in addition to other systems or components of aircraft systems 200. Aircraft systems 200 may also include any of various sensors coupled to air data computer 240, flight management system 220, and/or potentially also coupled to any of the systems or components of aircraft systems 200. Aircraft systems 200 may also include a data bus 270, which may include communication and networking system features that may interconnect the various systems and components of aircraft systems 200 as illustratively shown in FIG. 2. TCAS computer 262, air traffic data surveillance system 260, and navigation information system 230, among other elements of aircraft systems 200, may thus communicate data between each other via data bus 270.

In the example of FIG. 2, TCAS computer 262 may receive ADS-B or other radio surveillance messages from surrounding aircraft via antenna 205. In other examples, another type of ADS-B In receiver or radio surveillance receiver may receive radio surveillance messages from surrounding aircraft. TCAS computer 262 may receive radio signals embodying ADS-B messages and perform processing of the radio signals to isolate or extract the data of the ADS-B or other radio surveillance messages. TCAS computer 262 may then communicate the data of the ADS-B or other radio surveillance messages to other elements of aircraft systems 200 including air traffic data surveillance system 260. For example, each ADS-B message may include data for a latitude, a longitude, an aircraft flight ID, range, bearing, ground track, ground speed, altitude, and/or other data for the transmitting aircraft.

TCAS computer 262 and/or other elements of air traffic data surveillance system 260 may perform processing functions to generate air traffic surveillance data based on the ADS-B or other radio surveillance messages as provided by TCAS computer 262. In other words, TCAS computer 262 and/or other elements of air traffic data surveillance system 260 of aircraft 100 may convert the aircraft data from the ADS-B or other radio surveillance messages from surrounding aircraft to air traffic surveillance data. The air traffic surveillance data generated by TCAS computer 262 or other system may include at least partial coverage for the minimum radius around the reporting aircraft 1100 defined by the surveillance range 102 of reporting aircraft 100. The air traffic surveillance data generated by TCAS computer 262 or other system may include at least one of a latitude, a longitude, a flight identifier (ID), a range, a bearing, a ground track, a ground speed, or an altitude for at least one of the additional aircraft.

As part of eliminating duplicate ADS-B data and/or converting the ADS-B data to air traffic surveillance data, air traffic data surveillance system 260 may consolidate a substantial amount of ADS-B data, such as by removing duplicate information on a single aircraft communicated in multiple ADS-B messages from that one aircraft. The duplicate information may include duplicated declarations of the single aircraft's latitude, longitude, ID, range, bearing, ground track, ground speed, altitude, and/or other values from each of a series of consecutive ADS-B messages from that one aircraft, for example. Air traffic data surveillance system 260 may also remove or overwrite earlier data entries that are superseded by the most recent or current data entries for time series data such as aircraft position, air speed, or heading. In other examples, air traffic data surveillance system 260 may include or use another type of traffic computer besides a TCAS computer.

As part of its processing, air traffic data surveillance system 260 may identify ADS-B message data from multiple messages from a single aircraft, confirm that those messages are from the same reporting aircraft, eliminate duplicate data from multiple messages from that one aircraft, and only incorporate new or unique information from the various ADS-B messages from that one reporting aircraft for inclusion in the air traffic surveillance data. For example, air traffic data surveillance system 260 may only select information such as an updated aircraft position, or an indication of whether or not previously reported values of latitude, longitude, bearing, ground track, ground speed, altitude, etc. have remained identical or been newly altered, from the ADS-B message data for inclusion in the air traffic surveillance data. Air traffic data surveillance system 260 may include one or more displays for presenting graphical information for the pilot, such as on a Cockpit Display of Traffic Information (CDTI).

Air traffic data surveillance system 260 may also communicate the air traffic surveillance data to navigation information system 230, satellite data unit 232, and/or other system capable of transmitting data to a remotely operable data link system, such as by being enabled to transmit data to data link satellite 124. In this example, navigation information system 230 may receive the air traffic surveillance data from air traffic data surveillance system 260 via data bus 270, prepare the air traffic surveillance data for transmission via the data link system applicable to data link satellite 124, and communicate the prepared air traffic surveillance data to satellite data unit 232. Satellite data unit 232 may then transmit the air traffic surveillance data to data link satellite 124 via data link communication channel 206 via antenna 207. Data link satellite 124 may then transmit the air traffic surveillance data to ground station 110 and to compositing system 120 via data link communication channel 208. Satellite data unit 232 may include one or more amplifiers and may be configured to perform functions such as directing transmissions via antenna 207 to data link satellite 124 and receiving transmissions via antenna 207 from data link satellite 124. While only a single data link satellite 124 is depicted in FIGS. 1 and 2, in other examples, two or more data link satellites may relay the air traffic surveillance data between aircraft 100 and compositing system 120. Ground station 110 may have features such as one or more radio antennae and communication hardware for receiving and processing the air traffic surveillance data from data link satellite 124 and inputting the air traffic surveillance data to compositing system 120. Compositing system 120 may include various computing elements that may perform functions of receiving the air traffic surveillance data and combining the air traffic surveillance data into a composite air traffic surveillance data set, as further described below.

As indicated above, one or more of processors 242 and/or memory 244 and/or data storage 246 may be part of and/or be coupled to any of various systems among aircraft systems 200, such as TCAS computer 262, air traffic data surveillance system 260, and/or navigation information system 230. One or more processors 242, as well as other processors disclosed herein, may include any one or more of a microprocessor, a controller, a digital signal processor (DSP), an application specific integrated circuit (ASIC), a field-programmable gate array (FPGA), or equivalent discrete or integrated logic circuitry. In some examples, other features of aircraft systems 200, such as one or more of air traffic data surveillance system 260, TCAS computer 262, navigation information system 230, FMS 220, air data computer 240, and onboard weather radar system 250, may include respective processors, or the processing functions may be provided by one or more processors 242. The functions attributed to the one or more processors 242 (as well as other processors) in this disclosure may be embodied as software, firmware, hardware and combinations thereof.

Data storage 246 may include one or more hard disk drives, one or more flash drives, and/or one or more additional non-volatile or more or less long-term data storage devices. Memory 244 may include random access memory (RAM) integrated circuits, cache circuits, and/or one or more volatile or more or less short-term data storage devices. Data storage 246 and/or memory 244 may also include one or more devices or systems that may function or be used as either long-term data storage and/or short-term memory. Processors 242, memory 244, and/or data storage 246 may store, execute, and/or embody algorithms that may perform, contribute to, store, or embody any of the functions and/or data described herein.

TCAS computer 262 may make incoming ADS-8 messages available to one or more components of aircraft systems 200 and/or to one or more applications running on or being executed by one or more components of aircraft systems 200, potentially such as air data computer 240, air traffic data surveillance system 260, and/or flight management system 220. For example, TCAS computer 262 and/or another system (e.g., flight management system 220) may use incoming ADS-B messages to track the positions and velocities of surrounding aircraft and to calculate (independently of and redundantly with compositing system station 110) whether a potential need arises to alter course to maintain a safe distance from other aircraft. As another example, air traffic data surveillance system 260 may use incoming ADS-B messages to display icons or representations of surrounding aircraft (e.g., on an electronic flight bag (EFB) or CDTI).

Navigation information system 230 may include, e.g., an Inertial Navigation System (INS), a Global Positioning System (GPS), or any combination thereof. Navigation information system 230 and/or other components of aircraft systems 200 may include ADS-B Out transmission preparation and processing functions that enable aircraft systems 200 to transmit ADS-B messages, as may be applicable to any of the aircraft in airspace 101 as shown in FIG. 1, to be received by participating aircraft 100, 106, 108, whether or not those ADS-B Out transmitting aircraft participate in transmitting air traffic surveillance data to compositing system 120. Air traffic data surveillance system 260 may also include a primary flight display (PFD), a multifunction display (MFD), a navigation display, an electronic flight bag (EFB), or any other suitable display.

Figure 3:
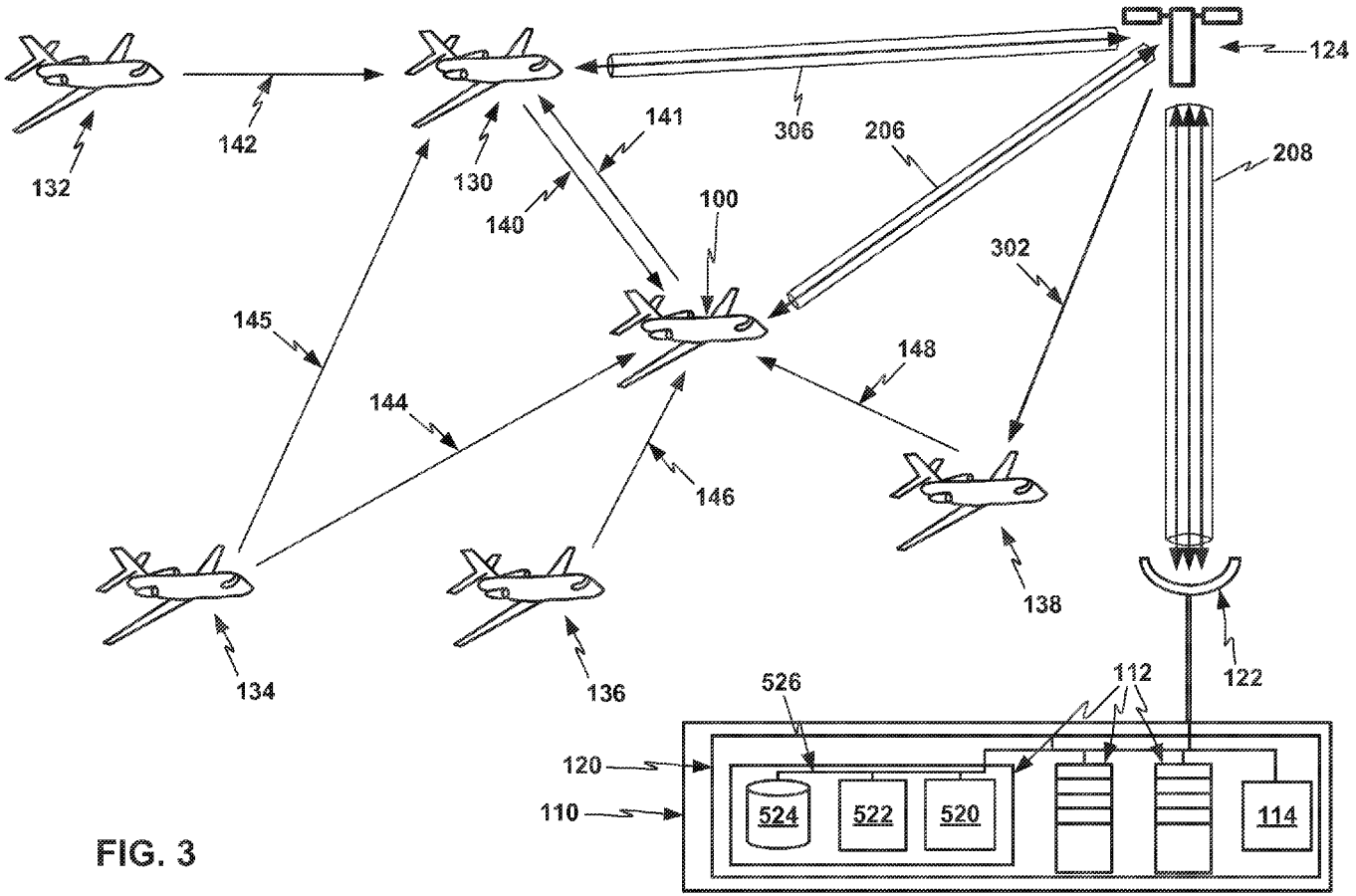
FIG. 3 shows another view of a subset of the example airspace as shown in FIG. 1 and a view of additional elements of an example compositing system hosted at a ground station.

FIG. 3 shows another view of a subset of example airspace 101 as shown in FIG. 1 and a view of additional elements of example compositing system 120 hosted by ground station 110. Aircraft 100 receives ADS-B messages from surrounding aircraft within its surveillance range, including ADS-B transmissions 140 from aircraft 130, ADS-B transmissions 144 from aircraft 134, ADS-B transmissions 146 from aircraft 136, and ADS-B transmissions 148 from aircraft 138, as examples of what could include many more aircraft within surveillance range of aircraft 100. Aircraft 100 is configured to communicate with compositing system 120 via data link communication channel 206 between aircraft 100 and data link satellite 124 and via data link communication channel 208 between data link satellite 124 and compositing system 120 (and potentially including additional space-based, airborne, and/or ground-based communication relays or other assets).

In this example, aircraft 130 is another aircraft that participates in communicating or reporting radio surveillance-based air traffic surveillance data to compositing system 120. Aircraft 130 is configured, similarly to aircraft 100 in this example, to communicate with compositing system 120 via data link communication channel 306 between aircraft 130 and data link satellite 124 and via data link communication channel 208 between data link satellite 124 and compositing system 120. Aircraft 130 also receives ADS-B messages from surrounding aircraft in its surveillance range, including ADS-B transmissions 141 from aircraft 100, ADS-B transmissions 145 from aircraft 134, and ADS-B transmissions 142 from aircraft 132. Aircraft 100 and aircraft 130 therefore receive ADS-B data from each other, and aircraft 100 and aircraft 130 both receive ADS-B data from representative aircraft 134, which may also apply to many other aircraft within surveillance range of both aircraft 100 and aircraft 130. Aircraft 132 is within surveillance range of aircraft 130 but out of range of aircraft 100, which may also be applicable to many other aircraft within surveillance range of aircraft 130 but not of aircraft 100. Aircraft 130 may generate air traffic surveillance data based on its own set of ADS-B message data received from aircraft in its range to transmit to compositing system 120, in a similar manner as aircraft 100 as described above.

Aircraft 100 and aircraft 130 may therefore both provide ADS-B-based air traffic surveillance data to compositing system 120 such that some of their air traffic surveillance data is overlapping, and some of their air traffic surveillance data is unique and only from a single aircraft. This example may be more generally applicable among larger numbers of participating aircraft that communicate their air traffic surveillance data to compositing system 120, such that significant amounts of the air traffic surveillance data compositing system 120 receives is uniquely sourced from only a single participating reporting aircraft, while significant amounts of the air traffic surveillance data compositing system 120 receives is overlapping from two or more participating reporting aircraft.

Compositing system 120 may be implemented in a wide variety of configurations that may include one or more computing devices and one or more communication devices. As shown in the example of FIG. 3, compositing system 120 includes multiple computing devices 112 and a transceiver 114 in data communication with radio antenna 122 and with computing devices 112, in this example. A representative one of computing devices 112 is shown to include a processor 520, a memory 522, and a data storage unit 524, communicatively coupled via a data bus 526. Transceiver 114 may be configured to receive air traffic surveillance data from one or more aircraft via one or more remotely operable data link systems, including by way of data link satellite 124 or a system that includes data link satellite 124. Transceiver 114 may include all required circuitry and hardware for receiving and processing data from the data link system.

Processor 520 may include any one or more of a microprocessor, a controller, a DSP, an ASIC, a FPGA, or equivalent discrete or integrated logic circuitry. The functions attributed to processor 520 may be embodied as software, firmware, hardware and combinations thereof. Memory 522 may include random access memory (RAM) integrated circuits, cache circuits, and/or one or more volatile or more or less short-term data storage devices.

Processor 520 of compositing system 120 may receive sets of air traffic surveillance data, potentially with some overlaps, from one or more aircraft such as aircraft 100 and 130, and combine the air traffic surveillance data from the one or more aircraft, such as aircraft 100 and 130, into a composite air traffic surveillance data set. While the air traffic surveillance data is substantially consolidated into relevant information of smaller data size from the original ADS-B data by each participating aircraft in the process of generating the air traffic surveillance data, processor 520 may in some examples consolidate its combined collection of air traffic surveillance data further by checking for duplicate information from air traffic surveillance data transmitted by aircraft with overlapping surveillance ranges, as part of or prior to combining the air traffic surveillance data from the one or more aircraft into the composite air traffic surveillance data set. Processor 520 may in some examples also confirm that the duplicate, overlapping data is mutually consistent or use the overlapping data to perform error cross-checks or error correction, such as by comparing error correction bits or aircraft data between data sets reported by multiple reporting aircraft, prior to consolidating the duplicate data into the composite air traffic surveillance data set, as part of or prior to combining the air traffic surveillance data from the one or more aircraft into the composite air traffic surveillance data set.

Compositing system 120 is also communicatively connected to, or may be considered to include, additional communication features besides transceiver 114 such as radio antenna 122 to enable a broadband data link channel with data link satellite 124, enabling receiving signals from and transmitting signals to data link satellite 124. These elements may contribute to compositing system 120 combining the air traffic surveillance data from the one or more aircraft into the composite air traffic surveillance data set.

Processor 520 may communicate the composite air traffic surveillance data set to transceiver 114. Transceiver 114 is configured to communicate the composite air traffic surveillance data set to one or more recipients, such as one or more recipient aircraft, and potentially one or more ground control stations, such as an Air Traffic Control (ATC) station or other facilities operated by an Air Navigation Service Provider (ANSP). In some examples, these recipient aircraft may include the participating reporting aircraft including aircraft 100, 130 and the composite air traffic surveillance data set may be transmitted to the other aircraft via the respective data link channels 206, 306. In addition, or instead, the recipient aircraft to which compositing system 120 transmits its composite air traffic surveillance data set may also include any number of other aircraft such as aircraft 138 that do not participate in reporting to compositing system 120. Compositing system 120 and data link satellite 124 may send transmissions to non-reporting aircraft via transmissions, such as transmission channel 302 to recipient aircraft 138, that may not necessarily be the same type or the same bandwidth as data link channels 206, 306 established by participating reporting aircraft such as data link channels 206, 306 used by aircraft 100, 130, but that may have sufficient bandwidth to communicate the composite air traffic surveillance data set in or close to "real-time", as further discussed below. The recipient aircraft may generate a nominally real-time display of or based on the composite air traffic display data sets (multiple such sets refreshed in succession in nominal real-time) on a cockpit display, such as may be implemented as a part of air traffic data display system 260 as discussed above, or in any other form that may be useful to a pilot operating the recipient aircraft or useful to any other system aboard the recipient aircraft.

Compositing system 120 may potentially transmit its composite air traffic surveillance data set to up to most or all of the aircraft in the relevant airspace 101. The composite air traffic surveillance data set transmitted by compositing system 120 may provide the recipient aircraft with complete coverage of all necessary data on all aircraft traffic within relevant range for flight planning and safety. For example, the composite traffic surveillance data set transmitted by compositing system 120 may include the latitude, longitude, flight identifier (ID), the range, the bearing, the ground track, the ground speed, and the altitude for all of the aircraft within the surveillance range of any of its reporting aircraft, which may be all of the aircraft in the entire airspace, or all of the aircraft in an entire track system such as the North Atlantic Track System (NATS), for example. Compositing system 120 may further splice together or integrate ground-based radio surveillance or radar coverage from ground-based systems with its remote airspace coverage from its reporting aircraft along the areas of overlap between the ground-based systems and a remote coverage system of this disclosure. For example, an authority or service provider such as the FAA may operate a Traffic Information Service-Broadcast (TIS-B) system that provides secondary surveillance radar (SSR) data in an ADS-B-like format, and compositing system 120 may receive the TIS-B data (e.g., ADS-B-like data containing SSR data) from the TIS-B provider and integrate the TIS-B data with its composite air traffic surveillance data prior to transmitting the composite air traffic surveillance data to receiving aircraft.

Compositing system 120 may transmit or communicate the composite air traffic surveillance data set to one or more recipient aircraft in nominal "real-time" or within a nominal latency of receiving the air traffic surveillance data from the one or more aircraft. The nominal real-time may be characterized in accordance with data latency standards in the industry. For example, data latency standards in the industry may specify overall data latency driven by requirements of the most stringent application that will use the data. Industry standards may establish common time reference so all consumers of the surveillance data can know how old the data is. The nominal real-time may also be characterized by little or no delay perceptible by pilots operating the recipient aircraft, at least in comparison with traditional ground-based air traffic control systems. The nominal real-time may be characterized by pilots and air traffic authorities considering it close enough to real-time to enable pilots to use it for effectively and safely operating the recipient aircraft, in accordance with industry and regulatory standards. The nominal real-time may involve a typical total round-trip latency, between the one or more reporting aircraft receiving their ADS-B data, transmitting their ADS-B-based air traffic surveillance data to compositing system 120, and receiving the composite air traffic surveillance data sets in a form rendered on their cockpit displays, of a fraction of approximately one second, or less than approximately five seconds, or less than approximately ten or fifteen seconds, in some examples.

In some examples, processor 520 of compositing system 120 may apply a subscriber agreement in managing and periodically confirming or modifying the list of its recipients to which to transmit the composite air traffic surveillance data set. Compositing system 120 may provide transmissions to different recipients in accordance with terms of service subscriptions with clients associated with the recipients, such as airlines or other operators of the aircraft. The recipients may also include entities other than operators of the aircraft, who may have different subscription terms, such as for occasional communications of composite air traffic surveillance data sets in bulk data form rather than for transmitting composite air traffic surveillance data sets in nominal real-time as with recipient aircraft in flight. Non-aircraft recipients may include a data mining system or an operator thereof, for example, that may analyze the composite air traffic surveillance data sets for additional useful purposes. Non-aircraft recipients may include an air navigation service provider (ANSI)), a jurisdictional aviation regulatory authority, an aeronautics agency, an academic research body, or other enterprise, any of which may subscribe to receive the composite air traffic surveillance data sets in real-time and/or in periodic bulk data.

As another example of a non-aircraft recipient subscribed to receive the composite air traffic surveillance data sets from compositing system 120 in real-time, an airline, aviation authority, or other enterprise may monitor the separations between the aircraft in the airspace. The enterprise may compare the composite air traffic surveillance data sets with knowledge of procedural separation standards applicable to one or more target aircraft in the airspace, and may communicate to the flight crew of the target aircraft to provide recommendations to the flight crew regarding when they may likely be cleared to a more fuel-efficient or desirable altitude or heading. In some examples, this data link advisory could be detected by the aircraft's flight management system (FMS) 220 or other automated process or system and be presented to the flight crew of the target aircraft as a pre-optimized recommendation. The FMS 220 may compute when the target aircraft should climb to a new altitude and the advisory service or enterprise may know when the target aircraft is likely to be able to receive a clearance to climb. Combining these two elements of information may enable FMS 220 to recommend a climb request only when it's likely to be granted.

As yet another example of a non-aircraft recipient subscribed to receive the composite air traffic surveillance data sets from compositing system 120 in real-time, an aviation authority may use this service to monitor air traffic. The aviation authority may adjust permissible procedural separation standards between aircraft to enable more fuel-efficient and denser flight traffic in accordance with the aviation authority's real-time evaluation of the composite air traffic surveillance data sets, potentially in combination with additional data or external conditions.

While the example of FIGS. 1-3 shows a single integrated compositing system hosted at a single ground station 110, compositing system 120 may take a wide variety of other forms in other implementations. For example, compositing system 120 may be implemented across multiple assets such as geographically distributed data centers. In other examples, compositing system 120 or a control interface thereof may be implemented on a single mobile device such as a laptop or smartphone. In other examples, compositing system 120 may be hosted on one or more aircraft, which may coincide with one or more of the aircraft described above, such as example aircraft 100, such that all of the functions of compositing system 120 are performed on board aircraft 100. In other examples, compositing system 120 may be hosted on one or more space-based assets, which may coincide with data link satellite 124 and/or one or more additional satellites.

Figure 4:
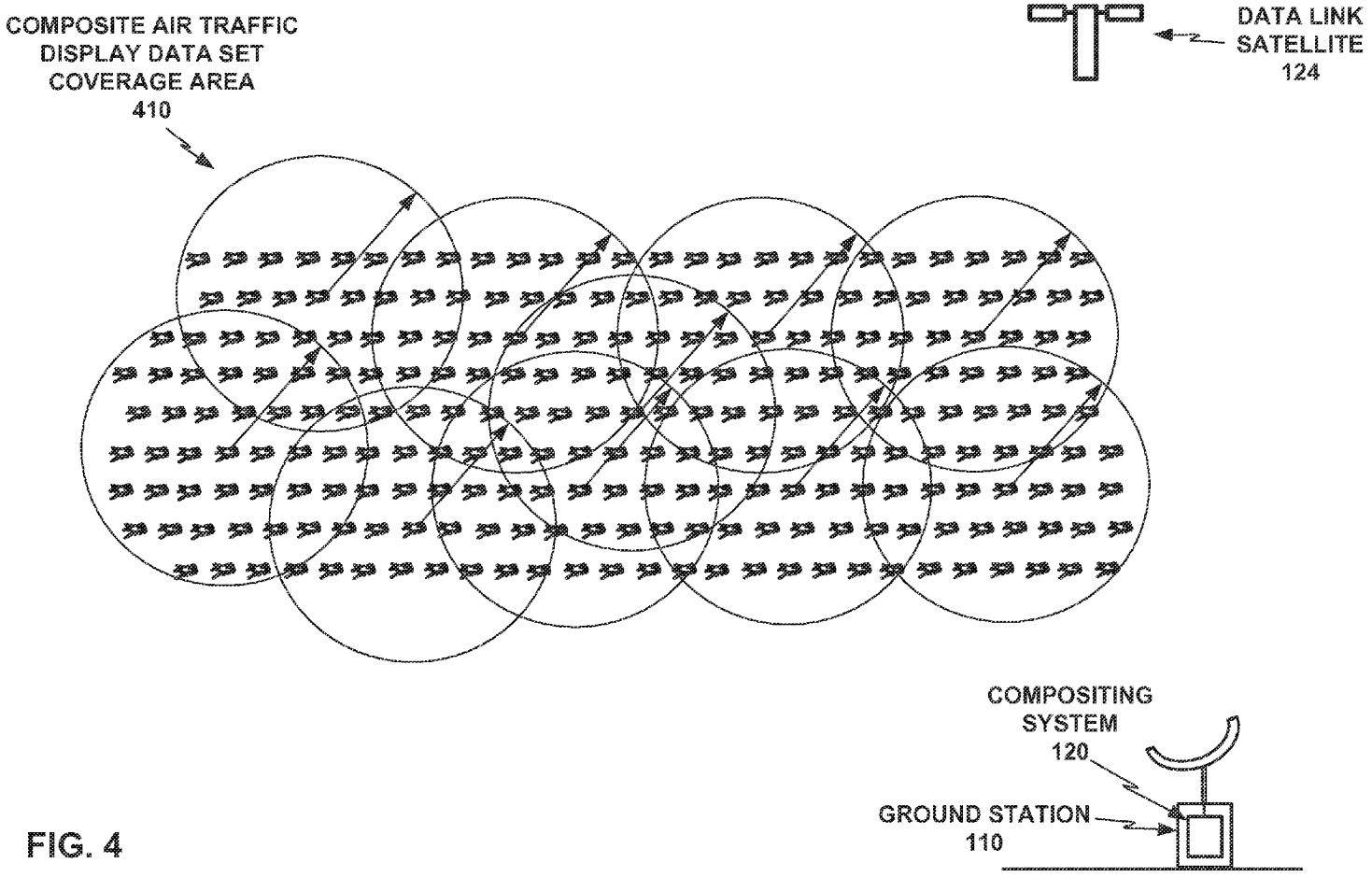
FIG. 4 shows a broader view of an example composite air traffic surveillance data coverage area, of real-time air traffic coverage that a compositing system hosted at a ground station may provide to recipients

FIG. 4 shows a broader view of an example composite air traffic surveillance data coverage area 410, of real-time air traffic coverage that compositing system 120 hosted at ground station 110 may provide to recipients. Composite air traffic surveillance data coverage area 410 may largely or entirely coincide with the airspace of an entire track system such as NATS, i.e., compositing system 120 may provide coverage of Composite air traffic surveillance data coverage area 410 for the airspace of the entire North Atlantic Ocean. As FIG. 4 shows, a small fraction of the total aircraft in the airspace may collectively provide sufficient surveillance coverage areas as reporting aircraft to compositing system 120, via data link satellite 124, to provide complete coverage area 410 for the entire track system, in this example. In this way, the devices, systems, and techniques described herein for compositing air traffic surveillance data may help provide a virtual ground station onboard an aircraft by aggregating information at a compositing system 120 that may not otherwise be available to a particular aircraft from another aircraft.

Figure 5:
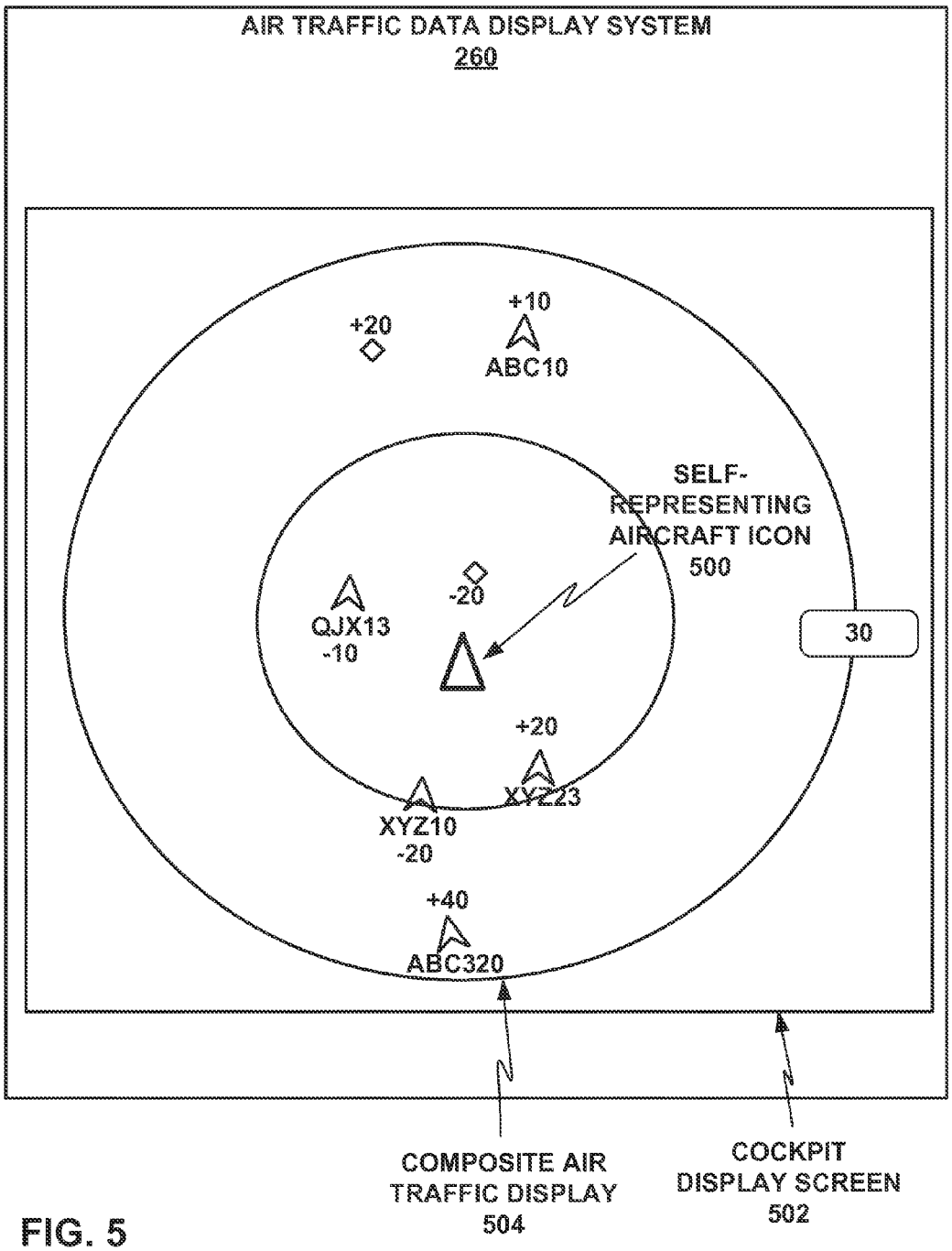
FIG. 5 shows an example cockpit surveillance screen that may be presented by an air traffic surveillance system of an aircraft, where the cockpit display screen displays composite air traffic displayed as either a complete or partial graphical rendering of a selected portion of a current real-time composite air traffic surveillance data set transmitted to the aircraft by the compositing system via a data link satellite, where the selected portion is centered on the current position of the aircraft.

FIG. 5 shows an example cockpit surveillance screen 502 that may be generated and presented by air traffic surveillance system 260 of aircraft 100 (e.g., on a CDTI) based on the composited air traffic surveillance data received from compositing system 120. Cockpit display screen 502 may display composite air traffic display 504 as either a complete or partial graphical rendering of a selected portion of a current real-time composite air traffic display data set transmitted to aircraft. 100 by compositing system 120 via data link satellite 124, where the selected portion is centered on the current position of aircraft 100. As FIG. 5 shows, composite air traffic display 504 shows a self-representing aircraft icon 500 at the center of cockpit display screen 502 to represent aircraft 100. As FIG. 5 shows, composite air traffic display 504 also shows various other aircraft icons at their accurate real-time current positions relative to aircraft 100, rotated in accurate real-time representations of their headings, and with indications of their aircraft ID's and accurate real-time altitude differentials relative to aircraft 100 (e.g., −10, +20, etc.).

Compositing system 120 may also compute and select individualized portions of its complete composite air traffic surveillance data sets for each recipient aircraft based on the current position of each recipient aircraft at that time, prior to compositing system 120 transmitting each composite air traffic surveillance data set. In this example, compositing system 120 may therefore transmit a number of different portions individualized for and individually addressed to each of the recipient aircraft. In other examples, compositing system 120 transmits each composite air traffic surveillance data set as a single larger undifferentiated data set, and each recipient aircraft (e.g., the air traffic surveillance system 260 thereof) may graphically render the appropriate portion of the composite air traffic surveillance data set centered on the current position of that aircraft.

Figure 6:
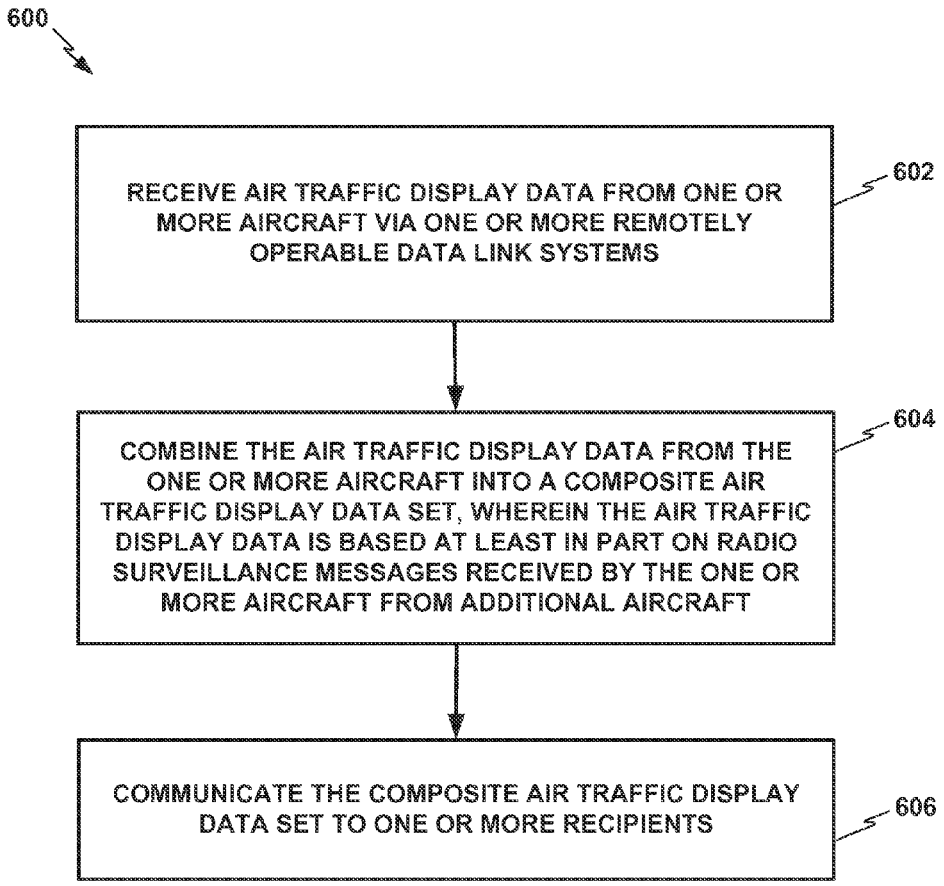
FIG. 6 shows a flowchart for an example method for combining radio surveillance data from multiple aircraft in a remote airspace into a composite air traffic surveillance data set.

FIG. 6 shows a flowchart for an example method 600 for combining radio surveillance data from multiple aircraft in a remote airspace into a composite air traffic surveillance data set, in accordance with illustrative aspects of this disclosure. For a compositing system 120 performing method 600, compositing system 120 receives air traffic surveillance data from one or more aircraft via one or more remotely operable data link systems (e.g., compositing system 120 receiving air traffic surveillance data from one or more of aircraft 100, 106, 108, 130, etc. via data link satellite 124 and/or other remotely operable data link system assets, as described herein with reference to FIGS. 1-5) (602). Compositing system 120 also combines the air traffic surveillance data from the one or more aircraft into a composite air traffic surveillance data set, wherein the air traffic surveillance data is based at least in part on radio surveillance messages received by the one or more aircraft from additional aircraft (e.g., compositing system 120 combining the air traffic surveillance data from the one or more aircraft into a composite air traffic surveillance data set, wherein the air traffic surveillance data is based at least in part on ADS-B messages or other radio surveillance messages received by the one or more aircraft 100, 106, 108, 130, etc. from additional aircraft such as all the aircraft in airspace 101 of FIG. 1; aircraft 100, 132, 134, 136, 138 of FIG. 3; and/or of the aircraft depicted in the composite air traffic surveillance data coverage area 410 and coinciding track system as shown in FIG. 4) (604). The radio surveillance messages may include ADS-B messages or other radio surveillance messages received by the one or more aircraft from the additional aircraft Method 600 may further include communicating the composite air traffic surveillance data set to one or more recipients (e.g., compositing system 120 communicating the composite air traffic surveillance data set to any of the aircraft depicted in FIGS. 1-4 or described herein and/or any non-aircraft recipient as described herein) (606).

Figure 7:
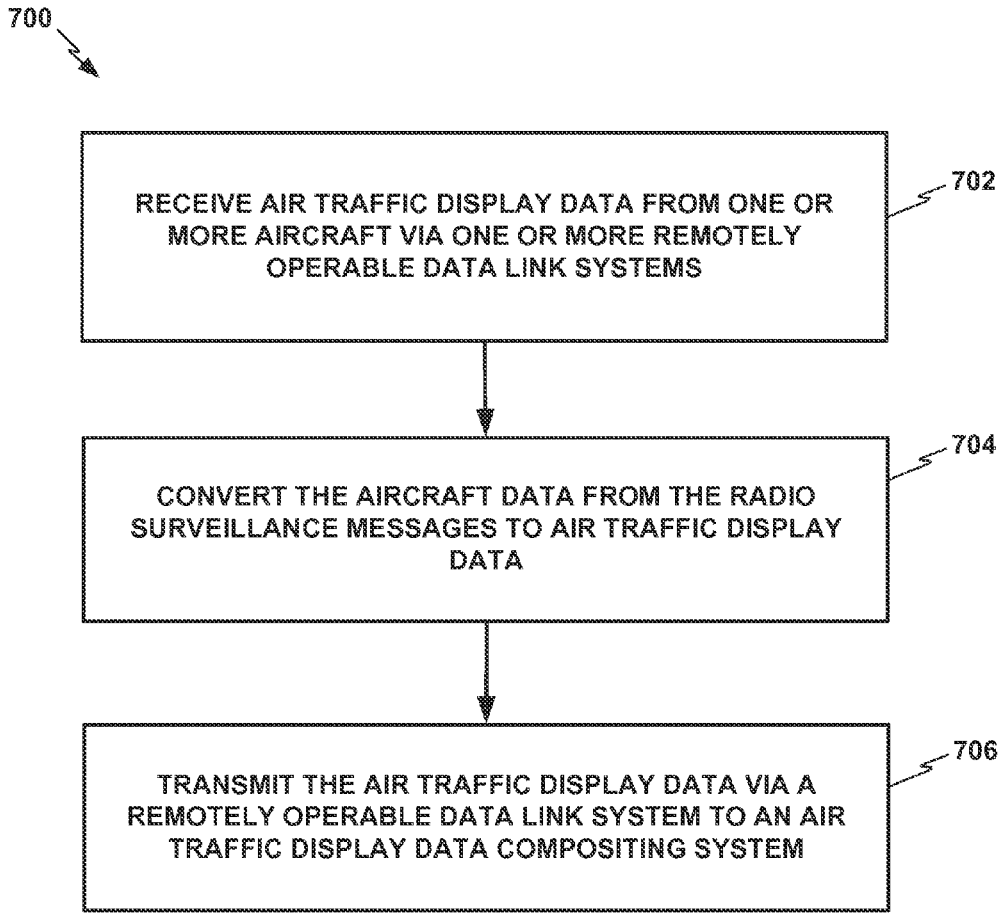
FIG. 7 shows a flowchart for an example method for communicating radio surveillance data from multiple aircraft in a remote airspace to an air traffic surveillance data compositing system.

FIG. 7 shows a flowchart for an example method 700 for combining radio surveillance data from multiple aircraft in a remote airspace into aggregated air traffic surveillance data to transmit to a compositing system, in accordance with illustrative aspects of this disclosure. For an aircraft or aircraft system (e.g., aircraft 100, and/or aircraft systems 200 which may be imputed to aircraft 100 for the discussion of FIG. 7 below) performing method 700, aircraft 100 receives radio surveillance messages comprising aircraft data from one or more aircraft (e.g., aircraft 100 and/or aircraft systems 200 receives radio surveillance messages comprising aircraft data from one or more aircraft including aircraft 106, 108, 130, 134, 136, 138, as described herein with reference to FIGS. 1-5) (702). Aircraft 100 also converts the aircraft data from the radio surveillance messages to air traffic surveillance data (e.g., aircraft 100 converts the aircraft data from the ADS-13 messages to air traffic surveillance data, as described herein with reference to FIGS. 1-5) (704). Aircraft 100 also transmits the air traffic surveillance data via a remotely operable data link system to an air traffic surveillance data compositing system (e.g., aircraft 100 transmits the air traffic surveillance data via a remotely operable data link system that includes data link satellite 124 to air traffic surveillance data compositing system 120, as described herein with reference to FIGS. 1-5) (706).

As indicated above, computing devices 112 of compositing system 120 may each include one or more processors, such as processor 520. The one or more processors, as well as other processors disclosed herein, can comprise any suitable arrangement of hardware, software, firmware, or any combination thereof, to perform the techniques attributed to compositing system 120 described herein. For example, the one or more processors may include any one or more microprocessors, digital signal processors (DSPs), application specific integrated circuits (ASICs), field programmable gate arrays (FPGAs), or any other equivalent integrated or discrete logic circuitry, as well as any combinations of such components. Compositing system 120 may also include a memory (e.g., as part of one or more computing devices 112), such as memory 522, which can include any volatile or non-volatile media, such as a RAM, ROM, non-volatile RAM (NVRAM), electrically erasable programmable ROM (EEPROM), flash memory, and the like. The memory may store computer readable instructions that, when executed by the one or more processors of compositing system 120 cause the processors to implement functions and techniques attributed to compositing system 120 herein. Similar descriptions may be applicable to any one or more of aircraft systems 200 aboard representative aircraft 100 or other participating reporting aircraft of this disclosure, such as TCAS computer 262, air traffic data surveillance system 260, CMU 210, navigation information system 230, or air data computer 240, for example.

Elements of compositing system 120 as disclosed above may be implemented in any of a variety of additional types of solid state circuit elements, such as central processing units (CPUs), application-specific integrated circuits (ASICs), a magnetic nonvolatile random-access memory, (RAM) or other types of memory, a mixed-signal integrated circuit, a field programmable gate array (FPGA), a microcontroller, a programmable logic controller (PLC), a system on a chip (SoC), a subsection of any of the above, an interconnected or distributed combination of any of the above, or any other type of component or one or more components capable of being configured in accordance with any of the examples disclosed herein. Elements of compositing system 120 may be programmed with various forms of software. Elements of compositing system 120 as in any of the examples herein may be implemented as a device, a system, an apparatus, and may embody or implement a method of combining air traffic surveillance data, including for implementing example method 600 as described with reference to FIG. 6. Similar descriptions may be applicable to any one or more of aircraft systems 200 aboard representative aircraft 100 or other participating reporting aircraft of this disclosure, such as TCAS computer 262, air traffic data surveillance system 260, CMU 210, navigation information system 230, or air data computer 240, for example.

Elements of a radio surveillance system as disclosed above may be implemented in any of a variety of additional types of solid state circuit elements, such as application-specific integrated circuits (ASICs), a magnetic nonvolatile random-access memory (RAM) or other types of memory, a mixed-signal integrated circuit, a central processing unit (CPU), afield programmable gate array (FPGA), microcontroller, a programmable logic controller (PLC), a system on a chip (SoC), a subsection of any of the above, an interconnected or distributed combination of any of the above, or any other type of component or one or more components capable of being configured in accordance with any of the examples disclosed herein. An "aircraft" as described and claimed herein may be or include any fixed-wing or rotary-wing aircraft, airship (e.g., dirigible or blimp buoyed by helium or other lighter-than-air gas), suborbital spaceplane or reusable launch vehicle stage, spacecraft, or other type of flying device, and may be crewed or uncrewed (e.g., uncrewed aerial vehicle (UAV) or flying robot). A radio surveillance system as in any of the examples herein may provide additional advantages in any of a variety of applications, including any application in which any form of radio surveillance and/or radar is used. This may include radio surveillance systems that include maritime vessels (potentially incorporating or integrating with Automatic Identification System (AIS)), ground vehicles, submarines, suborbital vehicles, orbital or hyperbolic space launch vehicles, and/or spacecraft, that may participate in reporting surveillance data to a traffic data compositing system, and/or that may participate in receiving composite traffic data sets from the compositing system. While some description uses the example of ADS-B radio surveillance data, other examples may use extensions or modifications to ADS-B, or other forms of ADS-B-like radio surveillance, or ADS-C or any kind of radio surveillance data, in any manner described in terms of the example of ADS-B data in the description herein.

Any of the systems of the examples of FIGS. 1-5 as described above, or any component thereof, may be implemented as a device, a system, an apparatus, and may embody or implement a method of implementing radio surveillance, including for implementing example method 600 as described with reference to FIG. 6. To "transmit" and to "communicate" may be considered synonymous throughout the description of this disclosure. A "remote airspace" as discussed herein may be an airspace over an ocean, a desert, a mountain range, a wasteland, or any large area that may be outside a range of strong coverage by traditional ground-based radio surveillance systems. "Remotely operable" as discussed herein may indicate being operable in any remote airspace as indicated above, and which may include one or more space-based assets such as data link satellites, airborne communication assets, fixed or mobile ground-based communication assets, or other remotely operable and remotely communicatively connected assets.

Various illustrative aspects of the disclosure are described above. These and other aspects are within the scope of the following claims.

What is claimed is:

1. A method comprising:

receiving, by one or more processors, air traffic surveillance data from one or more reporting aircraft via one or more remotely operable data link systems;

combining, by the one or more processors, the air traffic surveillance data received from the one or more reporting aircraft into a composite air traffic surveillance data set; and outputting, by the one or more processors, the composite air traffic surveillance data set, wherein the air traffic surveillance data is based at least in part on radio surveillance messages received by the one or more reporting aircraft from one or more additional aircraft, and the composite air traffic surveillance data set comprises air traffic surveillance data originally from the one or more reporting aircraft and air traffic surveillance data originally from the one or more additional aircraft.

2. The method of claim 1, wherein the radio surveillance messages comprise automatic dependent surveillance-broadcast (ADS-B) messages received by the one or more reporting aircraft from the one or more additional aircraft.

3. The method of claim 1, further comprising communicating the composite air traffic surveillance data set to one or more recipients.

4. The method of claim 3, wherein the one or more recipients comprise one or more recipient aircraft.

5. The method of claim 4, further comprising combining the air traffic surveillance data from the one or more reporting aircraft into the composite air traffic surveillance data set and communicating the composite air traffic surveillance data set to the one or more recipients within a nominal latency of receiving the air traffic surveillance data from the one or more reporting aircraft.

6. The method of claim 4, wherein the one or more recipient aircraft comprise at least one of the reporting aircraft.

7. The method of claim 4, wherein the one or more recipient aircraft do not comprise at least one of the reporting aircraft.

8. The method of claim 1, wherein the one or more remotely operable data link systems comprise a satellite configured to provide a communicative channel with at least one of the one or more reporting aircraft.

9. The method of claim 1, wherein the air traffic surveillance data comprises at least one of: a latitude, a longitude, a flight identifier (ID), a range, a bearing, a ground track, a ground speed, or an altitude for at least one of the additional aircraft.

10. The method of claim 1, further comprising generating the composite air traffic surveillance data set showing air traffic surveillance data for a minimum radius around each of the reporting aircraft.

11. The method of claim 10, wherein the minimum radius around each of the reporting aircraft is at least 150 nautical miles.

12. The method of claim 1, wherein receiving the air traffic surveillance data from the one or more reporting aircraft via the one or more remotely operable data link systems comprises receiving the air traffic surveillance data from two or more of the reporting aircraft via the one or more remotely operable data link systems, wherein combining the air traffic surveillance data from the one or more reporting aircraft into the composite air traffic surveillance data set comprises combining the air traffic surveillance data from the two or more reporting aircraft into the composite air traffic surveillance data set, and wherein the air traffic surveillance data is based at least in part on radio surveillance messages received by the two or more reporting aircraft from the one or more additional aircraft.

13. The method of claim 1, further comprising:

sending a request for updated air traffic surveillance data to one or more of the one or more reporting aircraft.

14. A system for combining radio surveillance data, the system comprising:

a transceiver configured to receive air traffic surveillance data from one or more reporting aircraft via one or more remotely operable data link systems; and a processor configured to combine the air traffic surveillance data received from the one or more reporting aircraft into a composite air traffic surveillance data set, and to output the composite air traffic surveillance data set, wherein the air traffic surveillance data is based at least in part on radio surveillance messages received by the one or more reporting aircraft from one or more additional aircraft, and the composite air traffic surveillance data set comprises air traffic surveillance data originally from the one or more aircraft and air traffic surveillance data originally from the one or more additional aircraft.

15. The system of claim 14, wherein the transceiver is further configured to communicate the composite air traffic surveillance data set to one or more recipients.

16. The system of claim 15, wherein the one or more recipients comprise one or more recipient aircraft, and the transceiver further being configured to communicate the composite air traffic surveillance data set to the one or more recipients within a nominal latency of receiving the air traffic surveillance data from the one or more reporting aircraft.

17. The system of claim 14, wherein the one or more remotely operable data link systems comprise a satellite configured to provide a communicative channel with at least one of the one or more reporting aircraft.

18. The system of claim 14, wherein the air traffic surveillance data comprises at least one of: a latitude, a longitude, a flight identifier (ID), a range, a bearing, a ground track, a ground speed, or an altitude for at least one of the additional aircraft.

19. The system of claim 14, the processor further being configured to generate the composite air traffic surveillance data set showing air traffic surveillance data for a minimum radius around each of the reporting aircraft.

20. A system for combining surveillance data, the system comprising:

means for receiving traffic surveillance data from one or more reporting vehicles via one or more remotely operable data link systems;

means for combining the traffic surveillance data from the one or more reporting vehicles into a composite traffic surveillance data set; and means for outputting the composite traffic surveillance data set, wherein the traffic surveillance data is based at least in part on surveillance messages received by the one or more vehicles from one or more additional vehicles, and the composite traffic surveillance data set comprises traffic data originally from the one or more reporting vehicles and traffic data originally from the one or more additional aircraft.

21. The system of claim 20, further comprising means for communicating the composite traffic surveillance data set to one or more recipients.

22. A method comprising:

receiving, by one or more processors, radio surveillance messages comprising aircraft data from one or more aircraft;

converting, by the one or more processors, the aircraft data from the radio surveillance messages to air traffic surveillance data; and outputting, by the one or more processors, the air traffic surveillance data for transmission via a remotely operable data link system to an air traffic surveillance data compositing system.

23. The method of claim 22, wherein the radio surveillance messages comprise automatic dependent surveillance-broadcast (ADS-B) messages received from the one or more aircraft.

24. The method of claim 22, wherein the one or more remotely operable data link systems comprise a satellite configured to provide a communicative channel accessible to the one or more processors.

25. The method of claim 22, wherein the air traffic surveillance data comprises air traffic situational awareness (ATSA) surveillance data.

26. The method of claim 22, wherein the air traffic surveillance data comprises at least one of a latitude, a longitude, a flight identifier (ID), a range, a bearing, a ground track, a ground speed, or an altitude for at least one of the additional one or more aircraft.

27. The method of claim 22, wherein the method is performed by an aircraft system aboard a reporting aircraft, wherein the air traffic surveillance data includes at least partial coverage for a minimum radius around the reporting aircraft.

* * * * *